US009089859B2

(12) United States Patent
Zhou et al.

(10) Patent No.: US 9,089,859 B2
(45) Date of Patent: Jul. 28, 2015

(54) POINT TOUCH SWITCH SHOWER HEAD

(75) Inventors: Huasong Zhou, Xiamen (CN); Zhongcheng Jin, Xiamen (CN); Jianmin Chen, Xiamen (CN); Hua Yao, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 137 days.

(21) Appl. No.: 14/008,602

(22) PCT Filed: Mar. 30, 2012

(86) PCT No.: PCT/CN2012/073282

§ 371 (c)(1),
(2), (4) Date: Sep. 30, 2013

(87) PCT Pub. No.: WO2012/130154

PCT Pub. Date: Oct. 4, 2012

(65) Prior Publication Data

US 2014/0319247 A1 Oct. 30, 2014

(30) Foreign Application Priority Data

Apr. 1, 2011 (CN) ..... 2011 1 0083213

(51) Int. Cl.

| | |
|---|---|
| ***B05B 1/18*** | (2006.01) |
| ***B05B 1/16*** | (2006.01) |
| ***B05B 15/06*** | (2006.01) |

(52) U.S. Cl.

CPC ..... *B05B 1/185* (2013.01); *B05B 1/1609* (2013.01); *B05B 1/1636* (2013.01); *B05B 15/067* (2013.01); *B05B 1/18* (2013.01)

(58) Field of Classification Search

CPC ..... B05B 1/1663; B05B 1/18; B05B 1/185; B05B 12/002; B05B 12/004; B05B 15/061; B05B 15/067; B05B 1/1636

USPC ..... 239/443–449, 577–579, 548, 556, 239/587.1–587.4

See application file for complete search history.

(56) References Cited

U.S. PATENT DOCUMENTS

| | | | | |
|---|---|---|---|---|
| 4,463,899 | A | 8/1984 | Tacchi | |
| 5,918,816 | A * | 7/1999 | Huber | 239/391 |
| 2010/0133364 | A1* | 6/2010 | Chen et al. | 239/587.5 |
| 2011/0186653 | A1* | 8/2011 | Cai et al. | 239/548 |

FOREIGN PATENT DOCUMENTS

| | | | |
|---|---|---|---|
| CN | 1236675 | A | 12/1999 |
| CN | 2915961 | Y | 6/2007 |
| CN | 201625597 | U | 11/2010 |

(Continued)

*Primary Examiner* — Len Tran
*Assistant Examiner* — Tuongminh Pham
(74) *Attorney, Agent, or Firm* — Rabin & Berdo, P.C.

(57) ABSTRACT

Disclosed is a shower head with a single-point touch switch. The shower head comprises a ball head component, a water-distributing unit. a switching unit and a wedge block. The ball head component has a protruding seat, and the protruding seat has a connection slot on its lower part. The water distributing unit is mounted on the swing component. The switching unit comprises a sliding bar and a switching disc. The wedge block is slidably connected with the water distributing unit and has an upward wedge on one side; and the upward wedge coordinates with the connecting slot. Sliding movement of the wedge block and sliding movement of sliding bars constitute an interlinking connection relationship. It is simple in structure, stable in configuration, and easy to operate.

15 Claims, 4 Drawing Sheets

(56) References Cited

FOREIGN PATENT DOCUMENTS

| | | | |
|---|---|---|---|
| CN | 201659037 | U | 12/2010 |
| CN | 201969618 | U | 9/2011 |
| DE | 102005059999 | A1 | 6/2007 |
| EP | 0634222 | A1 | 1/1995 |

* cited by examiner

POINT TOUCH SWITCH SHOWER HEAD

FIELD OF THE INVENTION

The present invention relates to a shower device, especially to a point touch switch shower head.

BACKGROUND OF THE INVENTION

In Chinese patent database, it is published with a single point touch shower of utility model in Dec. 1, 2010, the application is the same application of the present invention; the single point touch shower includes a fixation unit, an outlet and a switching mechanism. The fixation unit is disposed with an inlet waterway to connect to the water resource. The outlet is connected to the fixation unit in swinging way, and is disposed with several outlet functions, the switching mechanism includes a first ratchet, a stop catch and a driving mechanism, the first ratchet is connected to the outlet in freely rotating way, the stop catch is connected to the first ratchet and the outlet to limit the first ratchet to rotate backwards, the driving mechanism is connected to the first ratchet and the fixation unit to change the relatively swinging between the outlet and the fixation unit to the relatively rotating between the first ratchet and the outlet, the switch of the several outlet functions is realized by the relatively rotating of the first ratchet and the outlet. The structure of the existing technology is complex, it needs improvement to provide a simple one.

SUMMARY OF THE INVENTION

The present invention is provided with a point touch switch shower head, which overcomes the disadvantage of the existing single-point touch shower that the structure is complex.

The technical proposal of the present invention to solve the technical problem is as below:

A point touch switch shower head, includes:

A ball head component (100), which includes a swinging piece (110), the bottom of the side of the swinging piece (110) is disposed with a protruding seat (120), a connection slot (121) is disposed at the lower end of the protruding seat (120);

A water distribution unit (200), which is sleeved on the swinging piece (110), so that the water distribution unit (200) can swing with respect to the ball head component (100);

A switching unit, which includes a sliding bar (310) connected to the water distribution unit (200) and a switching disc (320) connected to the sliding bar (310), so that when the sliding bar (310) slides up and down with respect to the water distribution unit (200), the sliding bar (310) can rotate forwards, and when the switching disc (320) rotates with respect to the water distribution unit (200), the switch of the water is implemented; and A wedge block (400), which is connected to the water distribution unit (200) in sliding way, the wedge block (400) is disposed with an upward wedge (410) in one side, the upward wedge (410) is coupled to the connection slot (121), so that when the water distribution unit (200) swings with respect to the ball head component (100), the wedge block (400) is driven to slide with respect to the water distribution unit (200), and the sliding movement of the wedge block (400) and the sliding movement of sliding bars (310) constitute an interlinking connection relationship, so that when the wedge block (400) slides with respect to the water distribution unit (200), the sliding bar (310) is driven to slide with respect to the water distribution unit (200).

In another preferred embodiment, the sliding line of the sliding bar (310) and the water distribution unit (200) is a line (X), the sliding line of the wedge block (400) and the water distribution unit (200) is perpendicular to the line (X).

In another preferred embodiment, the cooperation of the sliding bar (310) and the water distribution unit (200) forms to be a mechanical pencil structure.

In another preferred embodiment, an automatic reposition function is disposed between the water distribution unit (200) and the ball head component (100).

In another preferred embodiment, the water distribution unit (200) includes a body (210) and an outlet (220) fixed inside the body (210), the body is sleeved on the swinging piece (110), so that the body (210) can swing with respect to the ball head component (100), the outlet (220) is disposed with several outlet waterways (221), the sliding bar (310) and the switching disc (320) are assembled to the outlet (220), so that when the switching disc (320) rotates with respect to the outlet (220), the outlet waterways (221) are switched.

In another preferred embodiment, the wedge block (400) is connected to the water distribution unit (200) in sliding forward and backward way; the wedge block (400) includes two wedge strips (420) of spaced left and right and a middle strip (430) fixed between the two wedge strips (420), the wedge strip (420) is disposed with an inclined surface fore and back; the top of the sliding bar (310) is extended out between the two wedge strips (420); a limiting block (440) is sleeved on the top of the sliding bar (310) in rotating way, the limiting block (440) is supported on the inclined surfaces of the two wedge strips (420).

In another preferred embodiment, two sides of the limiting block (440) are disposed with a roller (441), two rollers (441) are respectively connected on the inclined surfaces of the two wedge strips (420).

In another preferred embodiment, the body (210) is fixed with a fixation seat, the fixation seat includes a fixation wall (231) and a periphery wall (232) extended downward from the lower periphery of the fixation wall (231), the periphery wall (232) is fixed inside the body (210) in sealing way on the outlet (220), the fixation wall (231) is disposed with a water hole (233); the wedge block (400) is connected on the fixation wall (231) in sliding way; the switching disc (320) is disposed inside the periphery wall (232), the top of the sliding bar (310) is freely passing through the fixation wall (231).

In another preferred embodiment, the ball head component (100) further includes a tube (130), a ball head (140) and a connection sleeve (150), the swinging piece (110) is fixed to the lower portion of the tube (130), the ball head (140) is fixed to the upper portion of the tube (130), the connection sleeve (150) is sleeved on the outside of the upper portion of the tube (130); and the body (210) is sleeved on the outside of the tube (130), and is supported on the swinging piece (110).

Compared to the existing technology, the technical proposal of the present invention has advantages as below:

1. With the point touch water distribution unit, the water distribution unit can swing with respect to the ball head component, the swinging piece, the protruding seat, with the cooperation of the upward wedge and the connection slot, the wedge block sides, and it drives the sliding bar to slide and rotate to realize switch, the structure is simple, the mechanism is stable, it works at a low voltage, the operation is convenient;
2. The sliding bar and the water distribution unit are cooperated to form an mechanical pencil structure to cooperate with the swinging block to slide, the structure is simple and the mechanism is stable;
3. An automatic reposition function is disposed between the water distribution unit and the ball head component to cooperate with the mechanical pencil structure, the structure is simple and the mechanism is stable;

4. The top end of the sliding bar is extended out of two wedge strips, the limiting block is sleeved on the top end of the sliding bar in rotating way and supported on the inclined surfaces of the two wedge strips, so that the linking connection relationship between the sliding movement of the wedge block and the sliding movement of the sliding bar is simple and reliable;
5. The limiting block is disposed with a roller, the roller is connected on the inclined surface of the wedge strips, it prevents seizing, and the switch is labor-saving and convenient.

BRIEF DESCRIPTION OF THE DRAWINGS

The present invention will be further described with the drawings and the embodiments.

DETAILED DESCRIPTION OF THE EMBODIMENTS

Figure 1:
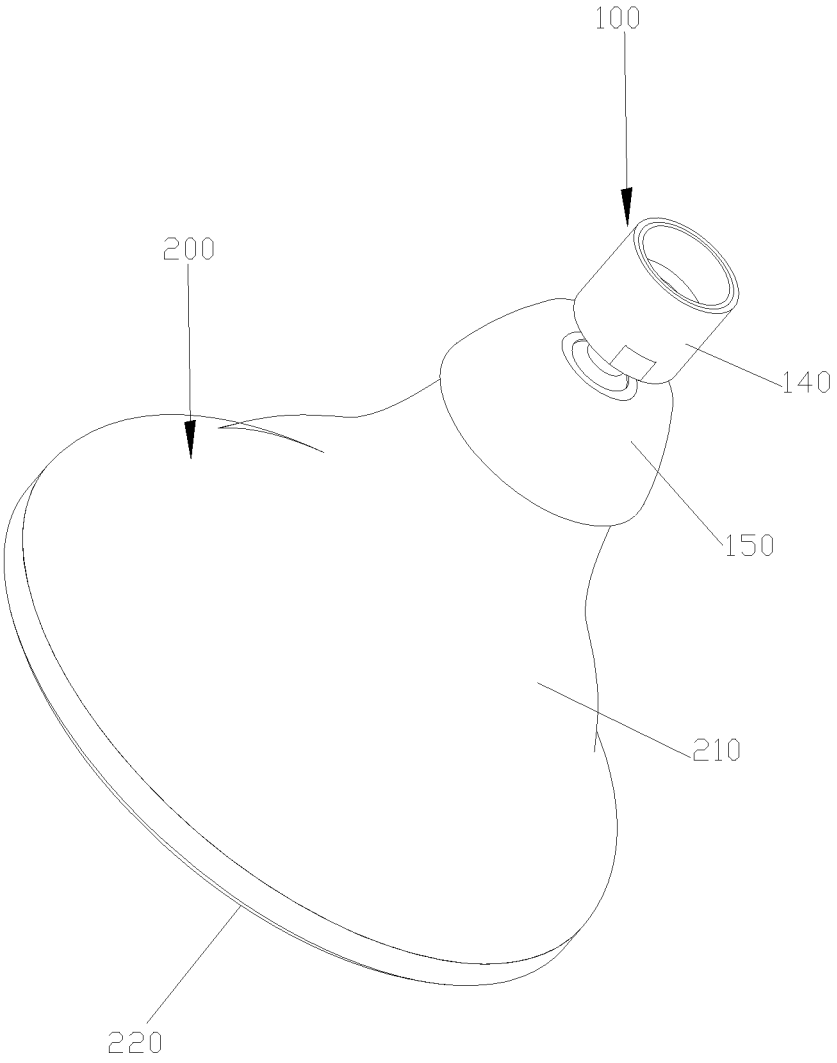
FIG. 1 illustrates the structure of the switch shower head of the preferred embodiment of the present invention.
Figure 2:
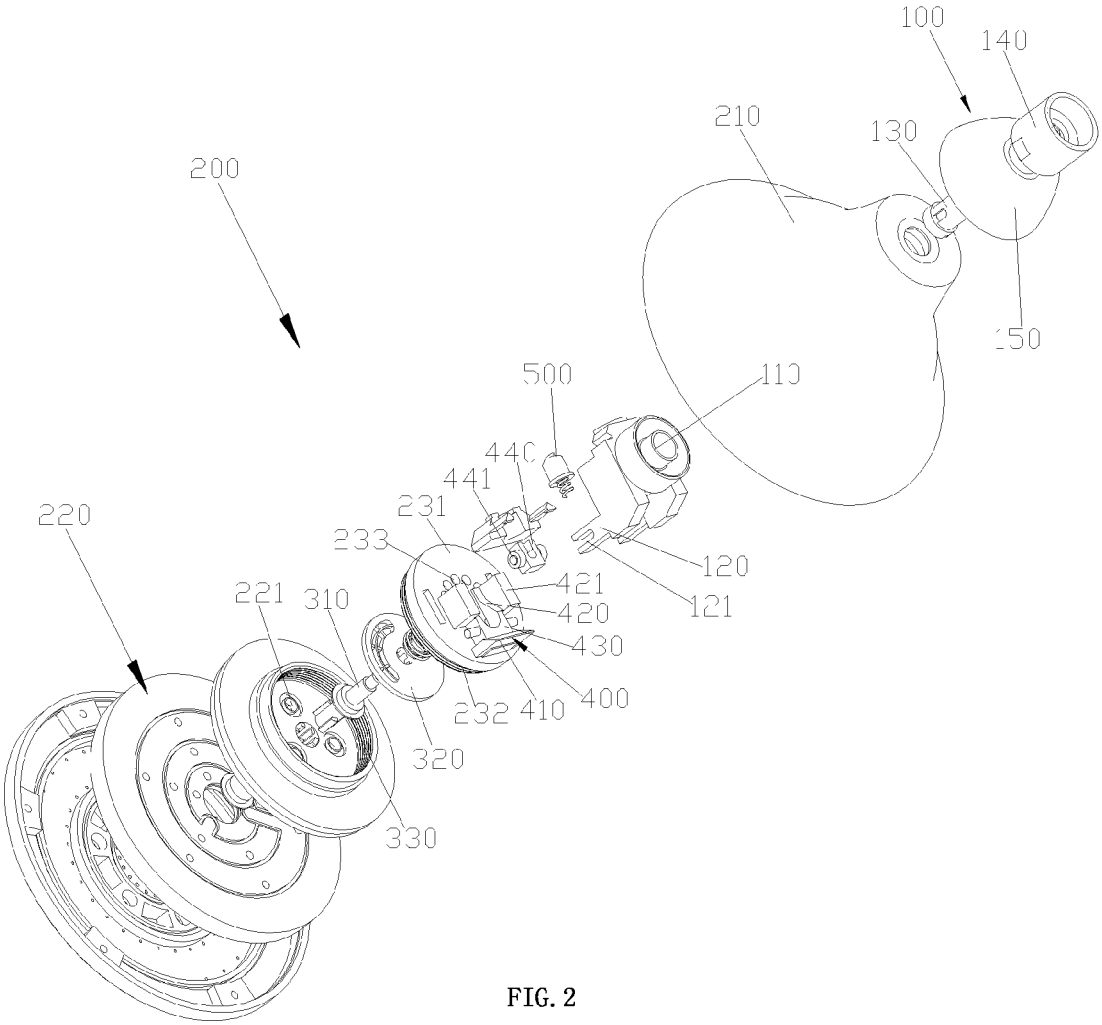
FIG. 2 illustrates the breakdown structure of the switch shower head of the preferred embodiment of the present invention.

Please refer to FIG. 1 to FIG. 4, a point touch switch shower head comprises a ball head component 100, a water distribution unit 200, a switching unit and a wedge block 400.

The ball head component 100 includes a swinging piece 110, a tube 130, a ball head 140 and a connection sleeve 150, the swinging piece 110 is fixed to the lower portion of the tube 130, and the bottom of one side of the swinging piece 110 is disposed with a protruding seat 120, the lower end of which is disposed with a connection slot 121, the ball head 140 is fixed to the upper portion of the tube 130, the connection sleeve 150 is sleeved on the outside of the lower portion of the tube 130.

The water distribution unit 200 includes a body 210 and an outlet 220 fixed inside the body 210 in sealing way. The body 210 is horn shaped, the periphery of the upper end of the horn body is extended inward to form a ring, the horn body is sleeved on the outside of the tube 130 and the swinging piece 110, the ring is supported on the swinging piece 110, so that the body 210 can swing with respect to the ball head component 100, and the water distribution unit 200 can swing with respect to the ball head component 100. The outlet 220 is disposed with several outlet waterways 221, each outlet waterway 221 has an outlet hole in the top surface of the outlet 220, and these outlet waterways 221 are annularly arranged.

The body 210 is disposed with a fixation seat, which includes a fixation wall 231 and a periphery wall 232 extended downwards from the lower periphery of the fixation wall 231, the periphery wall 232 is fixed inside the body 210 in sealing way on the top surface of the outlet 220, and the periphery wall 232 sleeves these outlet holes, the space inside the body 210, above the fixation wall 231 and below the ring forms the inlet cavity. In this embodiment, the fixation wall 231 is disposed with a water hole 233. Preferred, the outlet 220 is convex with a ring wall, the periphery wall is screwed inside the ring wall.

In this embodiment, the water flowing from the water resource flows into the inlet cavity through the ball head 140 and the tube 130, and then flows into the fixation seat from the inlet cavity through the water hole 233.

In this embodiment, an automatic reposition function is disposed between the body 210 of the water distribution unit 200 and the ball head component 100, the water distribution unit 200 is hanging to the ball head component 100, the automatic reposition is realized under the work of the gravity, as request, a reposition component 500 is disposed between the swinging piece 110 and the body 210.

The switching unit includes a sliding bar 310 and a switching disc 320, the sliding bar 310 is connected to the outlet 220, the switching disc 320 is connected to the sliding bar 310, so that when the sliding bar 310 slides up and down along the axis X of the water distribution unit 200 with respect to the outlet 220, the switching disc 320 is driven to rotate forwards, and the outlet waterways 221 are switched by the relative rotation of the switching disc 320 and the outlet 220. In this embodiment, the switching disc 320 is disposed inside the periphery wall 232 of the fixation seat, the switching disc 320 is disposed with a throughout hole, water inside the cavity of the fixation seat enters into the outlet waterways 221 through the throughout hole to realize waterways switch. In this embodiment, the sliding bar 310, the water distribution unit 200 and the reposition device are cooperated to be a mechanical pencil structure.

The mechanical pencil like structure is existing technology, it is generally disposed with a first ratchet in the sliding bar, a second ratchet in the outlet and a third ratchet in the switching disc, thereinto: the sliding bar 310 slides forwards with respect to the outlet 220, the first ratchet and the third ratchet are cooperated to make the switching disc 320 rotated forward an angle of ½A, and the reposition device stores energy; the reposition device releases energy and repositions, the sliding bar 310 slides backwards with respect to the sliding bar 310, the third ratchet and the second ratchet are cooperated to make the switching disc 320 rotated forward an angle of ½A, the sliding bar 310 repositions. In this embodiment, the angle of A is the rotating angle each time a switching needs, in this embodiment, the angle of A is the central angle of two adjacent outlet holes. In this embodiment, the reposition device can include a spring seat 330 fixed inside the sliding bar 310 inside the fixation seat, a first spring 340 is disposed between the fixation wall 231 and the switching disc 320, a second spring 350 is disposed between the spring seat 330 and the switching disc 320, The wedge block 400 can slide forward and backward and is connected on the fixation wall 231 of the water distribution unit 200. The wedge block 400 includes two wedge strips 420 of spaced left and right, a middle strip 430 fixed between the two wedge strips 420 and an upward wedge 410 protrude upward in the rear end of the middle strip 430, the upward wedge 410 is cooperated to the connection slot 121 of the protruding seat 120, so that when the water distribution unit 200 swings with respect to the ball head component 100, it can drive the wedge block 400 to slide forward and backward with respect to the fixation wall 231 of the water distribution unit 200, the wedge strip 420 is disposed with an inclined surface from fore to back. Preferred, a separation limiting block 421 is protruded and disposed at the outside of the two wedge strips 420.

The top end of the sliding bar 310 is passing through the fixation wall 231 in rotating and sliding way, and it is extended out of two wedge strips 420.

A limiting block 440 is further disposed and it is sleeved on the top end of the sliding bar 310 in rotating way, but it can not slide, the limiting block 440 is supported on the inclined surfaces of the wedge strips 420, so that the sliding movement of the limiting block 440 and the sliding movement of the sliding bar 310 form a linking connection relationship, so that when the wedge block 400 slides forward and backward with respect to the fixation wall 231 of the water distribution unit 200, it can drive the sliding bar 310 to slide up and down with respect to the water distribution unit 200. In this embodiment, two sides of the limiting block 440 are disposed with a roller 441, two rollers 441 are respectively connected on the inclined surfaces of the two wedge strips 420, two rollers 441 are situated between two separation limiting block 421.

Figure 3:
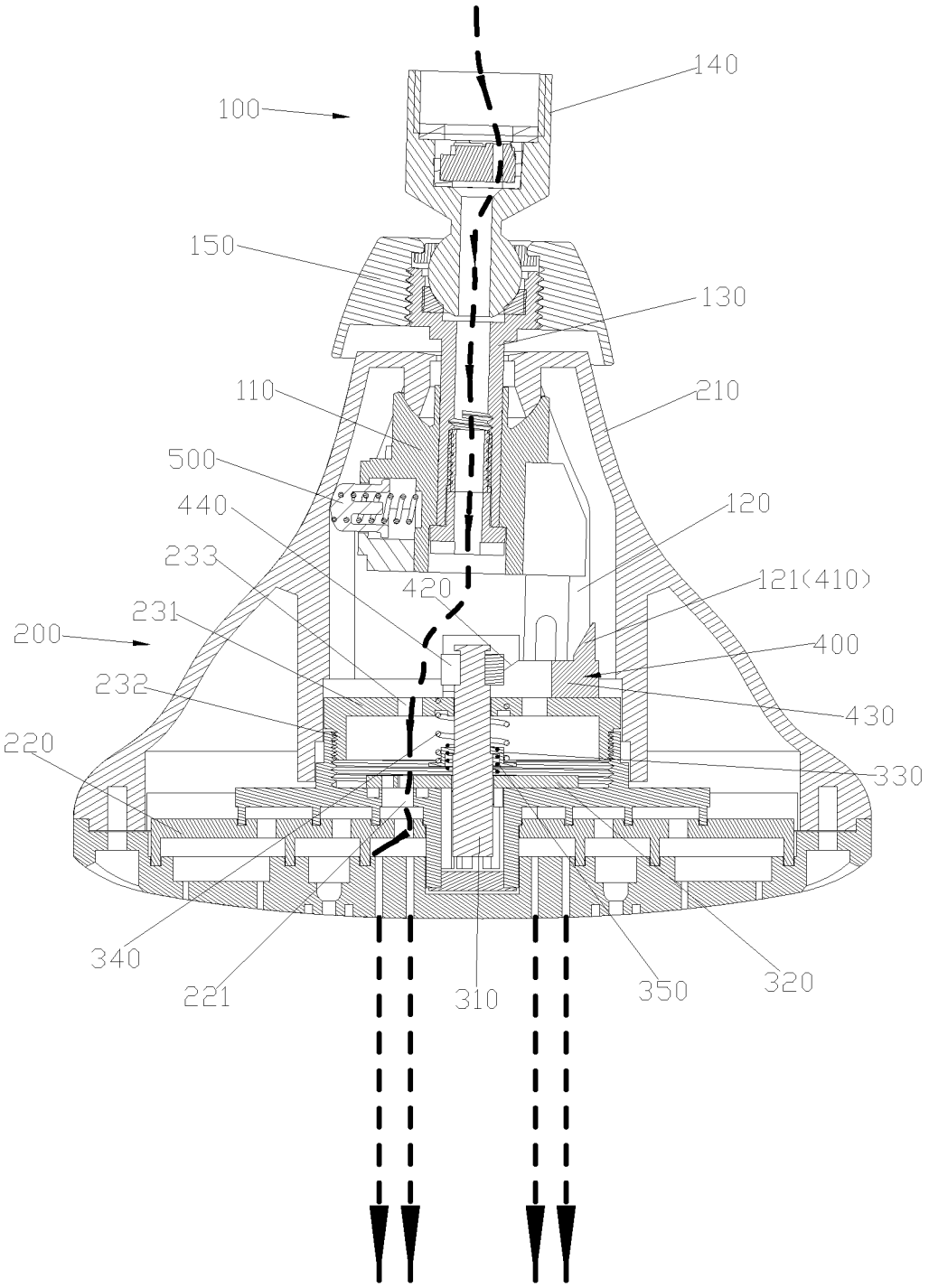
FIG. 3 illustrates the sectional view of the switch shower head of the preferred embodiment of the present invention, when the water distribution unit is situated in the middle position.
Figure 4:
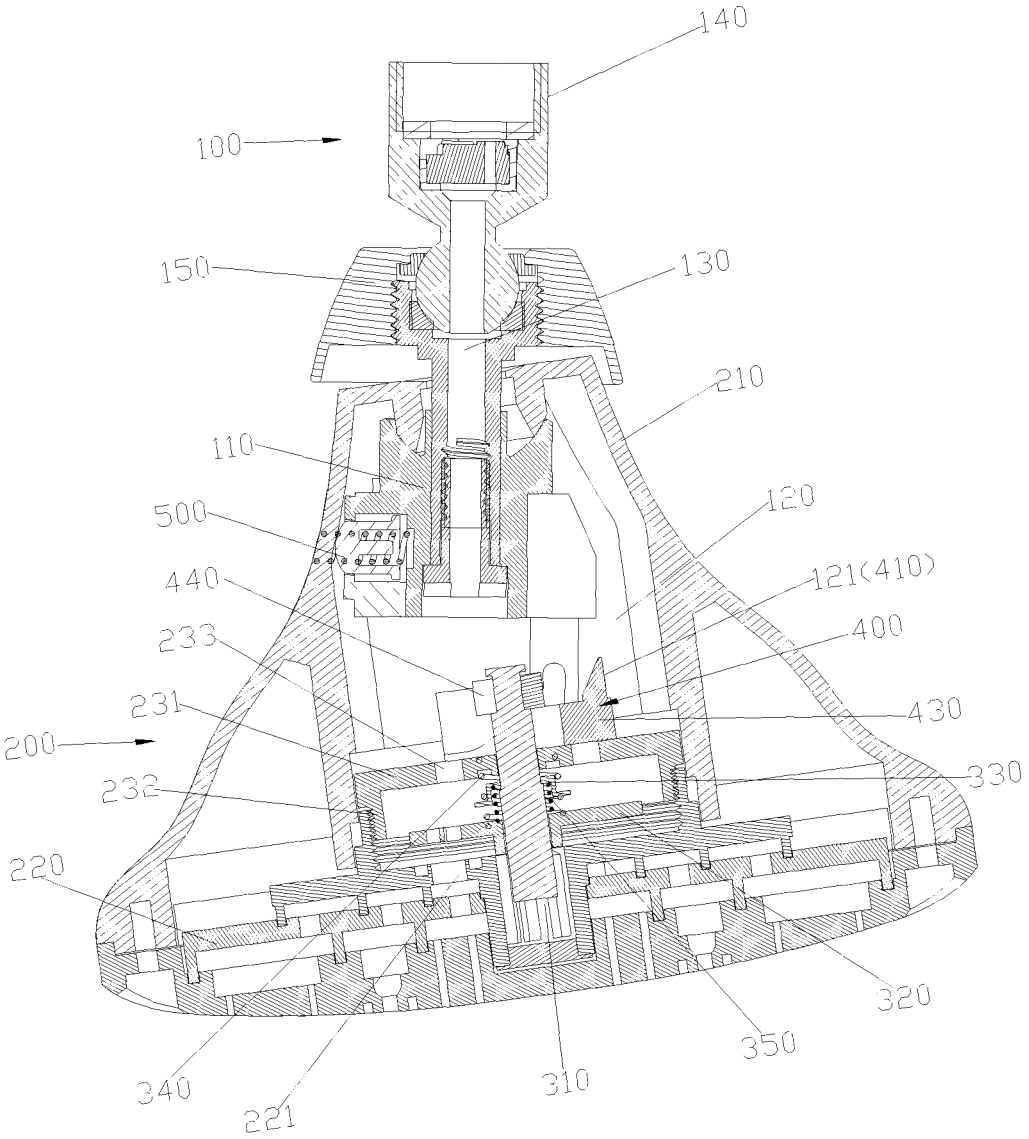
FIG. 4 illustrates the sectional view of the switch shower head of the preferred embodiment of the present invention, when the water distribution unit is situated in the swinging position.

Please refer to FIG. 3 and FIG. 4, (1). The users touches the outlet 220 in a point, making the water distribution unit 200 swung from the middle position to the swinging position with respect to the ball head component 100, making the water distribution unit 200 swung with respect to the swinging piece, when swinging, the connection slot of the protruding seat 120 is cooperated to the upward wedge 410 of the wedge block 400, making the wedge block 400 sliding forward with respect to the fixation wall 231, with the cooperation of the rollers 440 of the limiting block 440 and the inclined surfaces of the wedge block 400, the sliding bar 310 slides upwards, when sliding, the switching disc 320 rotates forward with an angle of A/2, when sliding, the first spring 340 and the second spring 350 are repositioned to store energy, the reposition function component 500 stores energy; (2). The user releases his hand, with the energy the gravity and the reposition function component 500 releases, the water distribution unit 200 is repositioned to the middle position from the swinging position, when swinging, the connection slot 121 of the protruding seat 120 is cooperated to the upward wedge 410 of the wedge block 400 to make the wedge block 400 sliding backward with respect to the fixation wall 231, with the cooperation of the rollers 441 of the limiting block 440 and the inclined surfaces of the wedge block 400 and the energy released from the first spring 340 and the second spring 350, the sliding bar 310 slides downward, when sliding, the switching disc 320 rotates forward with an angel of A/2; meanwhile, the switching disc 320 rotates forwards with an angel of A, making the throughout hole of the switching disc 320 switched from the first outlet waterway to the second outlet waterway, the switch of waterways is implemented.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided with a point touch switch shower head, which includes a ball head component, a water distribution unit, a switching unit and a wedge block. When the water distribution unit is touched in a point, the water distribution unit swings with respect to the ball head component, the swinging piece and the protruding seat, with the cooperation of the upward wedge and the connection slot, the wedge block slides to drive the sliding bar to slide and rotate, so that the switch of waterways is complemented, the structure is simple, the mechanism is stable, it can works at a low voltage, and it is operated conveniently.

The invention claimed is:

1. A point touch switch shower head, wherein includes:

a ball head component, which includes a swinging piece, a bottom of a side of the swinging piece being disposed with a protruding seat, a connection slot is disposed at a lower end of the protruding seat;

a water distribution unit, which is sleeved on the swinging piece, so that the water distribution unit can swing with respect to the ball head component;

a switching unit, which includes a sliding bar connected to the water distribution unit and a switching disc connected to the sliding bar, so that when the sliding bar slides up and down with respect to the water distribution unit, the sliding bar can rotate forwards, and when the switching disc rotates with respect to the water distribution unit, a switch of the water is implemented; and A wedge block, which is connected to the water distribution unit in a sliding arrangement, the wedge block being disposed with an upward wedge on one side, the upward wedge being coupled to the connection slot, so that when the water distribution unit swings with respect to the ball head component, the wedge block is driven to slide with respect to the water distribution unit, and a sliding movement of the wedge block and a sliding movement of the sliding bar constitute an interlinking connection relationship, so that when the wedge block slides with respect to the water distribution unit, the sliding bar is driven to slide with respect to the water distribution unit.

2. The point touch switch shower head according to claim 1, wherein a sliding direction of the sliding bar relative to the water distribution unit is a first direction, and a sliding direction of the wedge block relative to the water distribution unit is perpendicular to the first direction.

3. The point touch switch shower head according to claim 2, wherein a cooperation of the sliding bar and the water distribution unit forms a mechanical pencil like structure.

4. The point touch switch shower head according to claim 2, wherein an automatic reposition function is disposed between the water distribution unit and the ball head component.

5. The point touch switch shower head according to claim 2, wherein the water distribution unit includes a body and an outlet fixed inside the body, the body is sleeved on the swinging piece, so that the body can swing with respect to the ball head component, the outlet is disposed with several outlet waterways, the sliding bar and the switching disc are assembled to the outlet, so that when the switching disc rotates with respect to the outlet, the outlet waterways are switched.

6. The point touch switch shower head according to claim 2, wherein the wedge block is connected to the water distribution unit so as to slide forward and backward; the wedge block includes two wedge strips spaced left and right a middle strip fixed between the two wedge strips, the two wedge strips being disposed with an inclined surface; a top of the sliding bar being extended out between the two wedge strips; a limiting block being sleeved on the top of the sliding bar in a rotating arrangement, the limiting block is supported on the inclined surfaces of the two wedge strips.

7. The point touch switch shower head according to claim 6, wherein each sides of the limiting block is disposed with a roller, the rollers being respectively connected on the inclined surfaces of the two wedge strips.

8. The point touch switch shower head according to claim 5, wherein the body is fixed with a fixation seat, the fixation seat includes a fixation wall and a periphery wall extended downward from the lower periphery of the fixation wall, the periphery wall is fixed inside the body in sealing way on the outlet, the fixation wall is disposed with a water hole; the wedge block is connected on the fixation wall in a sliding arrangement; the switching disc is disposed inside the periphery wall, the top of the sliding bar is freely passing through the fixation wall.

9. The point touch switch shower head according to claim 5, wherein the ball head component further includes a tube, a ball head and a connection sleeve, the swinging piece is fixed to a lower portion of the tube, the ball head is fixed to an upper portion of the tube, the connection sleeve is sleeved on an outside of the upper portion of the tube; and the body is sleeved on the outside of the tube, and is supported on the swinging piece.

10. The point touch switch shower head according to claim 3, wherein the wedge block is connected to the water distribution unit in sliding forward and backward way; the wedge block includes two wedge strips of spaced left and right and a middle strip fixed between the two wedge strips, the wedge strip is disposed with an inclined surface fore and back; the top of the sliding bar is extended out between the two wedge strips; a limiting block is sleeved on the top of the sliding bar in rotating way, the limiting block is supported on the inclined surfaces of the two wedge strips.

11. The point touch switch shower head according to claim 4, wherein the wedge block is connected to the water distribution unit so as to slide forward and backward; the wedge block includes two wedge strips spaced left and right a middle strip fixed between the two wedge strips, the two wedge strips being disposed with an inclined surface; a top of the sliding bar is extended out between the two wedge strips; a limiting block being sleeved on the top of the sliding bar in a rotating arrangement, the limiting block is supported on the inclined surfaces of the two wedge strips.

12. The point touch switch shower head according to claim 5, wherein the wedge block is connected to the water distribution unit so as to slide forward and backward; the wedge block includes two wedge strips spaced left and right a middle strip fixed between the two wedge strips, the two wedge strips being disposed with an inclined surface; a top of the sliding bar is extended out between the two wedge strips; a limiting block being sleeved on the top of the sliding bar in a rotating arrangement, the limiting block is supported on the inclined surfaces of the two wedge strips.

13. The point touch switch shower head according to claim 10, wherein each side of the limiting block is disposed with a roller, the rollers being respectively connected on the inclined surfaces of the two wedge strips.

14. The point touch switch shower head according to claim 11, wherein each side of the limiting block is disposed with a roller, the rollers being respectively connected on the inclined surfaces of the two wedge strips.

15. The point touch switch shower head according to claim 12, wherein each side of the limiting block is disposed with a roller, the rollers being respectively connected on the inclined surfaces of the two wedge strips.

* * * * *